US008366495B2

(12) United States Patent
Nagy

(10) Patent No.: US 8,366,495 B2
(45) Date of Patent: Feb. 5, 2013

(54) APPLIANCE FOR CONNECTING HIGH-CURRENT ELECTRIC APPARATUSES, PRIMARILY CONDUCTOR BARS

(76) Inventor: Bela Nagy, Gyal (HU)

( * ) Notice: Subject to any disclaimer, the term of this patent is extended or adjusted under 35 U.S.C. 154(b) by 0 days.

(21) Appl. No.: 13/058,528

(22) PCT Filed: Aug. 10, 2009

(86) PCT No.: PCT/HU2009/000076

§ 371 (c)(1),
(2), (4) Date: Mar. 8, 2011

(87) PCT Pub. No.: WO2010/018419

PCT Pub. Date: Feb. 18, 2010

(65) Prior Publication Data

US 2011/0159736 A1 Jun. 30, 2011

(30) Foreign Application Priority Data

Aug. 12, 2008 (HU) ..... 0800510

(51) Int. Cl.
*H01R 4/44* (2006.01)

(52) U.S. Cl. ..... 439/781; 439/782; 439/783

(58) Field of Classification Search ..... 439/781–783
See application file for complete search history.

(56) References Cited

U.S. PATENT DOCUMENTS 3,058,764 A 10/1962 Scott et al.
3,071,750 A 1/1963 Heselwood
3,733,575 A * 5/1973 Gottschalk et al. ..... 439/781
4,772,703 A * 9/1988 Musser et al. ..... 544/283
5,692,930 A * 12/1997 Garver et al. ..... 439/781

FOREIGN PATENT DOCUMENTS

DE 2405313 A1 8/1974
GB 622571 A 5/1949
HU 186098 B 5/1985
HU 206795 A2 12/1992

* cited by examiner

*Primary Examiner* — Gary F. Paumen
(74) *Attorney, Agent, or Firm* — Birch, Stewart, Kolasch & Birch, LLP

(57) ABSTRACT

Appliance for connecting high-current electric apparatuses, primarily conductor bars, comprising an electrically conducting body (31) and at least one connection piece (22), where the connection piece (22) has a seat arranged to encircle the body (31) in a concentric manner. A preferably frustum-shaped retention portion having monotonic decreasing cross-sectional size is disposed on the body, the retention portion being retained in the seat by frictional connection. The retention portion has increased contact surface, and in specific cases the body (31) is adapted for receiving a cable end. The invention is essentially characterised by that the increased contact surface is constituted by indentations implemented as ribs arranged perpendicular to the axis of the body (31) and/or as grooves extending in the direction of the generator of the body (31), where the indentations undergo different amounts of local deformation along the axis of the body (31) as the appliance is pressed together.

14 Claims, 4 Drawing Sheets

Figure 1C:
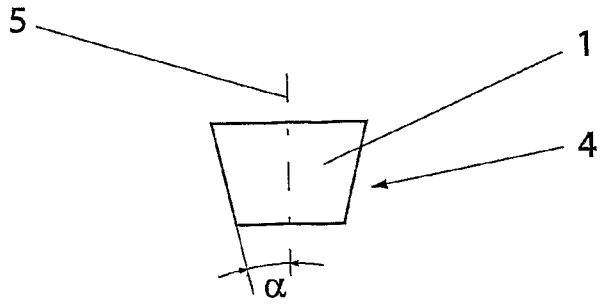

APPLIANCE FOR CONNECTING HIGH-CURRENT ELECTRIC APPARATUSES, PRIMARILY CONDUCTOR BARS

This Application is the National Phase Under 35 U.S.C. §371 of PCT International Application No. PCT/HU2009/000076 which has an International filing date Of Aug. 10, 2009, which claims priority to Hungarian Application No. P0800510 filed on Aug. 12, 2008. The entire contents of all applications listed above are hereby incorporated by reference.

The invention is related to an appliance for connecting high-current electric apparatuses, primarily conductor bars, comprising an electrically conducting body and at least one connection piece, where the connection piece has a seat arranged to encircle the body in a concentric manner. A preferably frustum-shaped retention portion having monotonic decreasing cross-sectional size is disposed on the body, the retention portion being retained in the seat by frictional connection. The retention portion has increased contact surface, and in specific cases the body is adapted for receiving a cable end.

Several solutions for making connections between high-current electrical apparatuses have seen widespread application. Patent description HU 186098 discloses an electrical connection appliance, having a body adapted for electric connection that has a slanted surface adapted for receiving at least one cable or wire, a clamping element adapted for pressing the cables or wires to be connected to the slanted surface, and a screw spindle applied for moving the clamping element with respect to the body. The body has a frustum-shaped cavity, with the clamping element also being frustum-shaped to fit into the cavity. This solution is not suitable for making electric connections between high-current conductor bars. Furthermore, the appliance is not capable of effectively disrupting the oxide layer that forms during sustained operation.

The joint element according to Hungarian patent description HU 206795 provides electrical connection between high-current electrical apparatuses. The joint element has interconnecting first and second subelements made from or coated with electrically conductive material. The first subelement is retained in the second subelement utilizing an expediently wedge-shaped connection. The joint element is configured such that the first subelement extends over and above the second subelement and has at least one support portion that may be pulled up over the first subelement and is adapted for securing the first subelement to the second subelement. Adjoining surfaces of the subelements and/or the outer surface of the second subelement has increased contact surface, while said surfaces of the subelements and/or the outer surface, as well as at least a portion of further adjoining surfaces are secured together under frictional force, preferably in a self-locking manner. The joint element according to the invention is capable of connecting conductor bars. The solution is also capable of eliminating contact errors caused by thermal movement and/or by conductor loosening resulting from occasionally occurring faults. The patent also teaches how to decrease to a certain amount the buildup of oxide layer that inevitably occurs under practical operating conditions.

The objective of the present invention is to improve upon the solution disclosed in the document HU 206 795 so as to provide for improved disruption of the oxide layer forming between the contact surfaces, and thereby decrease heating of the appliance and resulting losses.

The invention is based on the recognition that by increasing the size of clean to metal contacting surfaces the reliability and efficiency of the appliance may be improved. Contact surface size may be increased by providing indentations on one or both contacting surfaces.

The inventive objective is accomplished by the invention described in the introductory section such that the indentations of the increased contact surface are implemented as ribs arranged perpendicular to the axis of the body and/or as grooves extending in the direction of the generator of the body, where the indentations undergo different amounts of local deformation along the axis of the body as the appliance is pressed together.

The invention is capable of connecting high-current electric apparatuses, primarily conductor bars. The appliance may also be applied for interconnecting high-current cables and for connecting cables and conductor bars. The body of the appliance, as well as the connection pieces, may be made from electrically conductive material, for instance from aluminium alloy or copper alloy. Appliances where the body and/or the connection pieces are made from electrically non-conductive material having electrically conductive coating also fall into the scope of the present invention.

The appliance according to the invention corrects contact loosening caused by thermal movement or other dynamic movements in a conventional way, with the application of friction joints between connected elements. The friction joint is produced by disposing a retention portion having monotonic decreasing cross-sectional size on the body, which retention portion is press-fit into a suitably shaped seat disposed on the connection piece. The retention portion with monotonic decreasing cross-sectional size may for instance be a frustum-shaped body. Secure connection is produced by pressing said body into the seat of the connection piece.

The increased contact surface of the retention portion has ribs and/or grooves. As the connection is formed, sharp edges of the ribs and/or grooves break up the harmful oxide layer present on the contact surfaces, and the thus produced clean-to-metal contact points decrease the contact resistance of the connection. The number and size of contact points should be determined such that the sum total of contact surfaces corresponds to the desired connection area. Through defining the exact dimensions and arrangement of the ribs and/or grooves it is possible to increase the number of contact points and consequently their contact surface to an extent that provides secure electric contact and decreases losses.

In the assembled state of the appliance (when the elements are pressed together) the axis of the body coincides with the axis of the seat disposed in the connection pieces. Therefore in the context of the following description the term "axis" refers both to the principal axis of the body and the principal axis of the seat. According to a preferred embodiment of the invention the angle between the generator of the retention portion and the axis thereof is larger than the angle between the generator of the seat and said axis. This arrangement makes it possible that the rib flanges and/or the flutes may undergo a different amount of local deformation—increasing towards the lower-cross section portion of the retention portion—as the body and the connection piece are pressed together. The increased oxide-free contact surface ensure that contact resistance and consequently heat losses remain at favourable levels. According to a preferred embodiment of the invention the angle between the generator of the retention portion and/or the body and the principal axis remains constant along the contacting surfaces. According to a further preferred embodiment of the invention the angle between the generator of the retention portion and/or the body and the principal axis changes along the contacting surfaces.

In a preferred embodiment the ribs are implemented as triangular cross-section circular flanges. Measurement results have indicated that it is preferable for providing optimally dimensioned connection points if the height of the flange is 2-5% of the largest dimension of the retention portion as measured perpendicular to its axis, and the angle between the sides of each flange is 1-150°, preferably 85-95°

The grooves are implemented as flutes having preferably triangular cross section, extending in the direction of the generator of the retention portion, where the height of the flutes is 2-5% of the largest dimension of the retention portion as measured perpendicular to its axis, and where the angle between the sides of each flute is between 1-150°, preferably between 85-95°. According to a further preferred embodiment the angle between the generator of the flutes and the principal axis is smaller than the angle between the generator of the retention portion and said axis.

By carefully selecting the angle between connecting elements either self-locking or releasable connections may be produced between the retention portion and the connection piece. According to a preferred embodiment of the invention the angle between the generator of the retention portion and its principal axis is 1-60°. Lower angle values are preferably chosen in the embodiment where the principal axis of the body is parallel with the conductor bars, that is, where the body is wedged between the conductor bars.

In a further preferred embodiment, in case the angle between the generator of the retention portion and its axis is set to 1-7° the body may be connected to the connection piece in a self-locking manner. The body and the connection pieces may be made from the same material, or alternatively, in case a self-locking connection is applied, the material of the body may be harder than the material of the connection pieces.

According to another preferred embodiment of the invention, in case the connection is not self-locking it should be secured against loosening. In this case the body has a through-bore, with a retaining element being passed through the through-bore, and the body is retained in the seat assisted by a support element pulled up over the retaining element. In the embodiment having a non-self locking connection it may be preferable if the material of the connection piece is harder than the material of the body, because in case of such a hardness relation the contact points suffer less damage when the connection is released.

According to a further preferred embodiment of the invention insulation is disposed between the connection pieces. Thereby the loosening of the contact caused by differential heating and thermal movement of the connection pieces may be prevented.

Figure 1B:
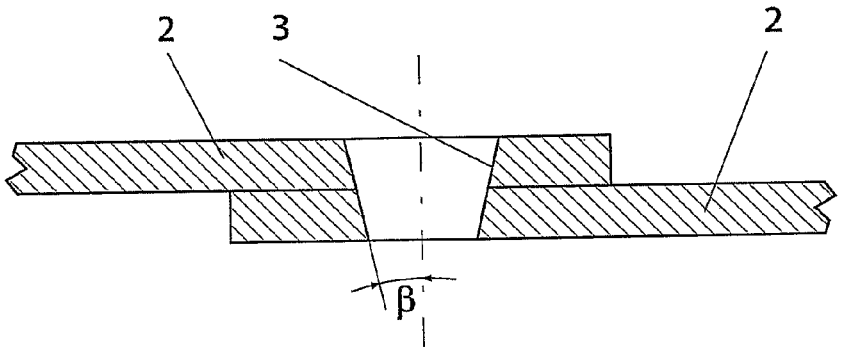
Figure 1A:
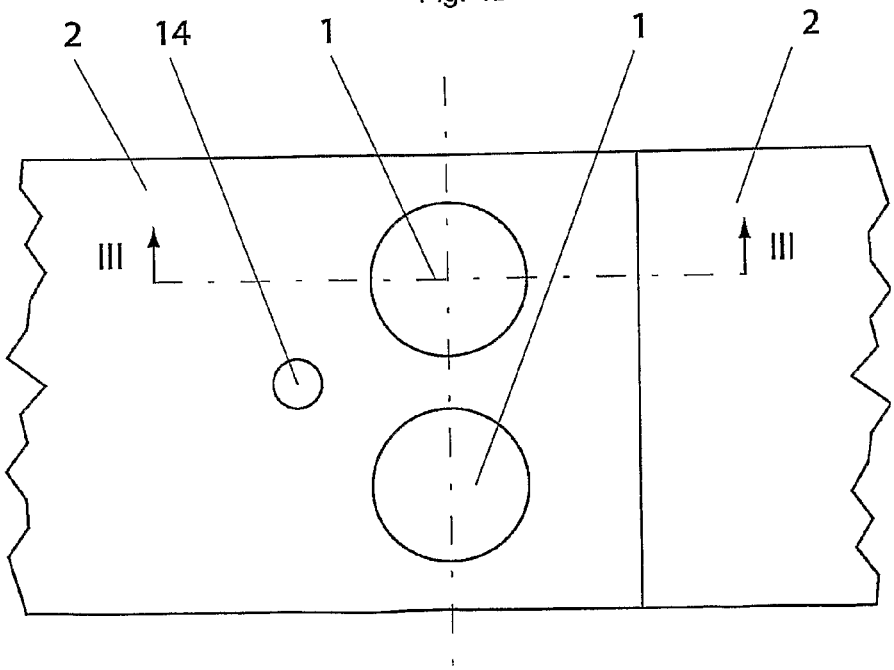
Figure 2:
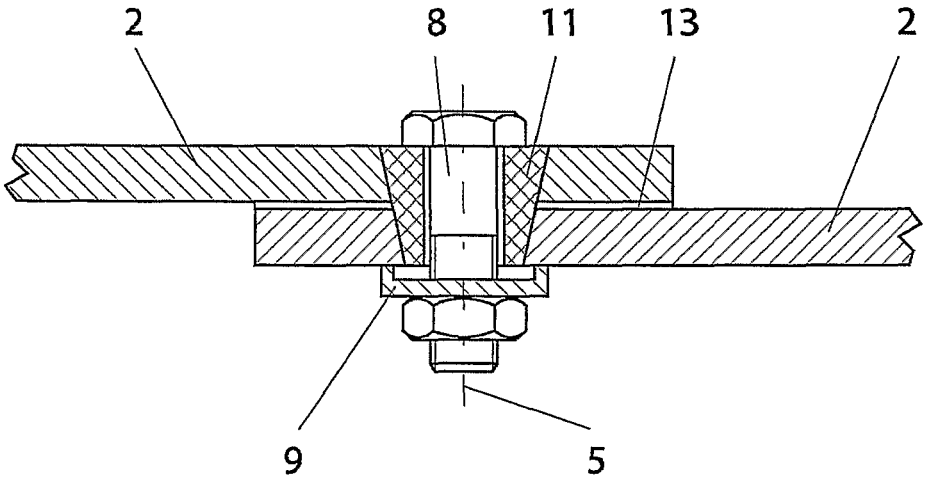
Figure 3A:
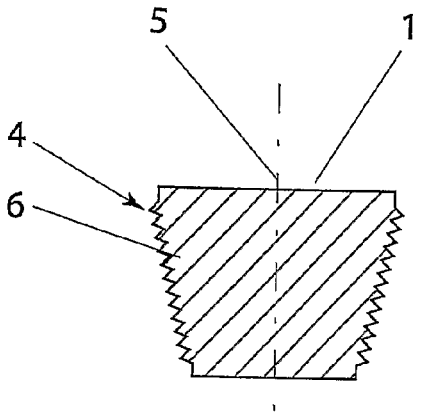
Figure 3B:
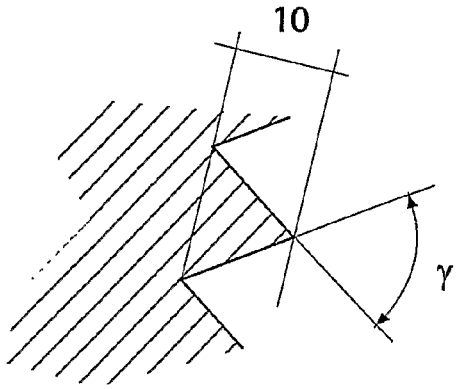
Figure 3C:
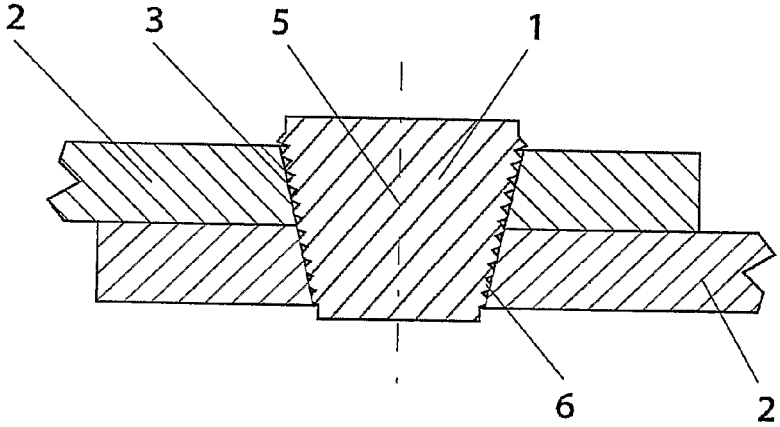
Figure 4:
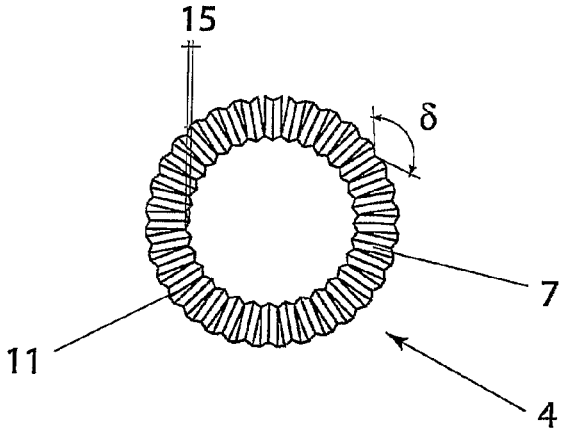
Figure 5:
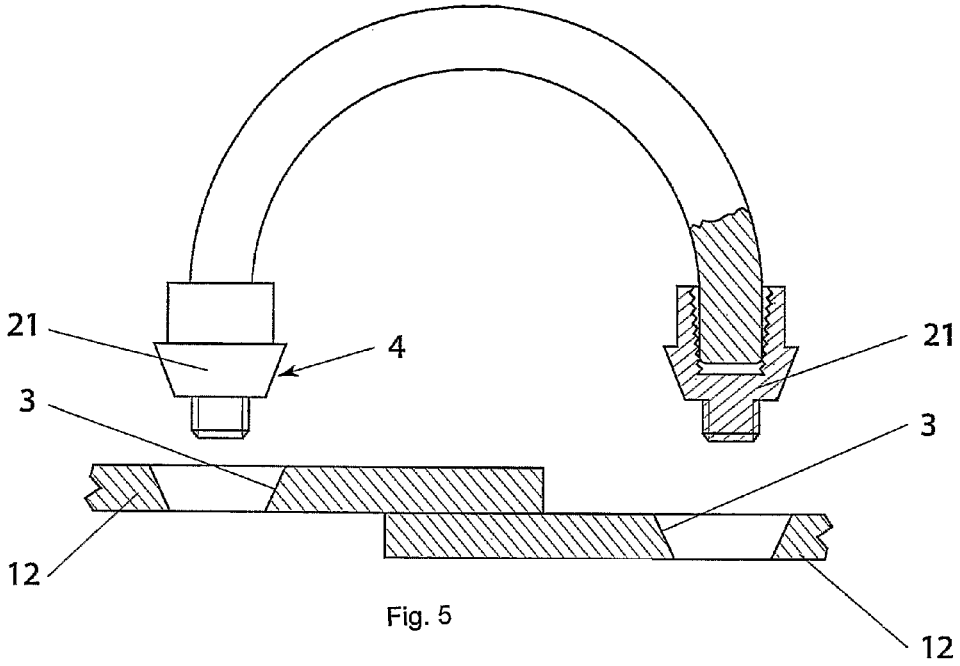
Figure 6:
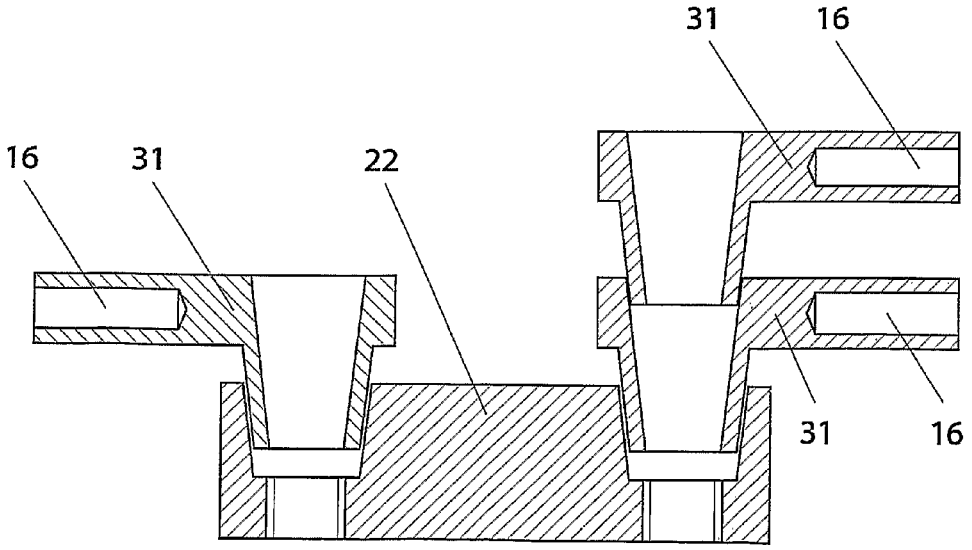

The invention will be explained in more detail with reference to conceivable embodiments illustrated in the attached drawings, where FIG. 1*a* shows the schematic top plan view of the appliance according to the invention, FIG. 1*b* is the schematic view of the connection piece of the appliance shown in FIG. 1*a*, FIG. 1*c* is the schematic side view of the body of the appliance shown in FIG. 1*a*, not showing ribs and/or grooves of the body, FIG. 2 is the sectional view of another embodiment of the appliance according to the invention, not showing ribs and/or grooves, FIG. 3*a* shows the sectional view, with ribs shown, of the body of FIG. 1*c*, FIG. 3*b* shows a larger scale view of a single rib of the body, FIG. 3*c* is a section of FIG. 1*a* taken in plane III-III, FIG. 4 shows the underside view of another preferred embodiment of the body according to the invention, FIG. 5 is the schematic view of a further preferred embodiment of the appliance according to the invention, and FIG. 6 shows the schematic view of a still further preferred embodiment of the appliance according to the invention.

FIGS. 1*a*-1*c* show the inventive appliance for connecting conductor bars. In the schematic drawings only those portions of the body 1 and connection pieces 2 are shown that are essential for connection. Ribs and/or grooves included for increasing connection surface are thus not shown. The connection pieces 2 and the body 1 are made from AlMgSi 0.5 F22 aluminium alloy. The entire lateral surface of the truncated cone-shaped body 1 is utilized to form a retention portion 4. The body 1 is pressed into a seat 3 formed in the connection pieces 2 to produce the connection. As it is shown in FIG. 1*a*, after the connection has been produced, the body 1 and the seat 3 have a common axis 5 of symmetry. The angle $\alpha$ between the generator of the body 1 and the axis 5 is 10°. The connection pieces have a seat 3 having an inner surface shaped as a truncated cone. The angle $\beta$ between the generator of the seat 3 and the axis 5 is 8°. The connection pieces 2 are joined by a retainer screw 14 to orient conductor bar ends and provide initial connection.

FIG. 2 shows another conceivable embodiment of the appliance according to the invention. In this embodiment the connection between the connection pieces 2 and the body 11 is not self-locking. A retaining element 8 is passed through the concentric bore of the truncated cone-shaped body 11. The retaining element 8 is applied for pressing together the body 11 and the connection pieces 2 by means of a nut and a support element 9. Insulation 13 is disposed between the connection pieces 2.

FIGS. 3*a*-3*c* and FIG. 4 illustrate the arrangement of the ribs 6 and/or grooves 7 of the retention portion 4. The ribs 6 are implemented as triangular cross-section flanges, where the height 10 of the flanges is 3% of the largest diameter of the retention portion 4. The angle $\delta$ between the sides of a flange is 90°. As the body 1 is pressed into the seat 3 disposed on the connection pieces 2, the deformation of flange edges increases in the direction of the lower-diameter part of the retention portion 4.

FIG. 4 shows an embodiment where the body 11 has grooves 7 extending in the direction of the generator of the body 11. The grooves 7 are implemented as triangular cross-section flutes, where the height 15 of the flutes is 3% of the largest diameter of the retention portion 4. The angle $\delta$ between the sides of the flutes is 90°.

FIG. 5 illustrates an embodiment where the appliance according to the invention is implemented as an overlapped bar joint. The retention portion 4 of the body 21 has ribs and grooves not shown in the drawing. The retention portions 4 are pressed into the seat 3 of the connection pieces 12. The body 21 has a central bore for retaining the connection cable. To enhance connection safety the body 21 has a threaded end.

FIG. 6 shows the inventive appliance implemented as a terminal block. The conical side surface of the body 31 has ribs and grooves to increase connection surface, and can be press-fit into the conical seat of the connection piece 22. A bore 16 is disposed in the body 31 for cable connection. The electric connection can be made by press-fitting the bodies 31 into one another or into the connection piece 22. Retaining elements (not shown in the drawing) are applied for securing the connected elements.

Compared to existing solutions the appliance according to the invention provides increased safety and efficiency connecting high-current electric apparatuses.

LIST OF REFERENCE NUMERALS

1, 11, 21, 31 body

2, 12, 22 connection piece

3 seat
4 retention portion
5 axis
6 rib
7 groove
8 retaining element
9 support element
10 height
13 insulation
14 retainer screw
15 height
16 bore
α angle
β angle
γ angle
δ angle

The invention claimed is:

1. An appliance for connecting high-current electric apparatuses, comprising an electrically conducting body and at least one connection piece, where the connection piece has a seat surface arranged to encircle the body in a concentric manner, a retention portion having monotonic decreasing cross-sectional size being disposed on the body, and wherein the retention portion is retained in the seat by frictional connection and the retention portion has increased contact surface, wherein the angle between the contact surface of the retention portion and the axis of the body is α, the contact surface is increased by indentations in the form of ribs arranged perpendicular to the axis of the body and/or as grooves extending along the axis of the body, wherein the ribs are in the form of triangular cross-section circular flanges, wherein the height of the flanges is 2-5% of the largest diameter of the retention portion as measured perpendicular to its axis, and wherein the angle (γ) between the sides of each flange is 1-150°, and/or wherein the grooves are in the form of flutes having a triangular cross section, extending from the axis of the body in an angle from 0° up to angle α, wherein the height of the flutes is 2-5% of the largest diameter of the retention portion as measured perpendicular to its axis, and where the angle (δ) between the sides of each flute is 1-150°, and wherein the indentations undergo different amounts of local deformation along the axis of the body as the appliance is pressed together.

2. The appliance according to claim 1, wherein the angle (α) between the contact surface of the retention portion and the axis thereof is larger than the angle between the seat surface and said axis.

3. The appliance according to claim 1, wherein the angle (α) between the contact surface of the retention portion and the axis thereof is of an angle such that the body is connected to the connection piece in a self-locking manner.

4. The appliance according to claim 3, wherein the body is comprised of a material that is harder than the material of the connection piece.

5. The appliance according to claim 1, wherein the body has a through-bore, with the body being retained in the seat by a retaining element passed through the through-bore and by a support element fitted against the connection piece, where the support element is pulled up over the retaining element.

6. The appliance according to claim 5, wherein the connection piece is comprised of a material that is harder than the material of the body.

7. The appliance according to claim 1, wherein insulation is disposed between the connection pieces.

8. The appliance according to claim 1 which is adapted for receiving a cable end.

9. The appliance according to claim 1, wherein said angle (δ) of 85-95°.

10. The appliance according to claim 1, wherein the angle (δ) is 86-95°.

11. An appliance for connecting conductor bars comprising an electrically conducting body and at least one connection piece, where the connection piece has a seat surface arranged to encircle the body in a concentric manner, a retention portion having monotonic decreasing cross-sectional size being disposed on the body, the retention portion being frustum-shaped, and wherein the retention portion is retained in the seat by frictional connection and the retention portion has increased contact surface, and said body being adapted for receiving a cable end, wherein the angle between the contact surface of the retention portion and the axis of the body is α, and wherein the contact surface is increased by indentations implemented as ribs arranged perpendicular to the axis of the body and/or as grooves extending along the axis of the body, wherein the ribs are in the form of triangular cross-section circular flanges, wherein the height of the flanges is 2-5% of the largest diameter of the retention portion as measured perpendicular to its axis, and wherein the angle (γ) between the sides of each flange is 85-95°, and/or wherein the grooves are in the form of flutes having a triangular cross section, extending from the axis of the body in an angle from 0° up to angle α, wherein the height of the flutes is 2-5% of the largest diameter of the retention portion as measured perpendicular to its axis, and where the angle (δ) between the sides of each flute is 85-95°, and wherein the indentations undergo different amounts of local deformation along the axis of the body as the appliance is pressed together.

12. The appliance according to claim 11, wherein the body is made from a material that is harder than the material of the connection piece.

13. The appliance according to claim 11, wherein the body has a through-bore, with the body being retained in the seat by a retaining element passed through the through-bore and by a support element fitted against the connection piece, where the support element is pulled up over the retaining element, and wherein the connection piece is made from a material that is harder than the material of the body.

14. The appliance according to claim 13, wherein insulation is disposed between the connection pieces.

* * * * *